United States Patent [19]

Dendooven

[11] Patent Number: 4,779,322

[45] Date of Patent: Oct. 25, 1988

[54] METHOD FOR THE MANUFACTURE OF GEAR-WHEEL CRIMPED METAL FIBERS AND PRODUCTS COMPRISING THESE FIBERS

[75] Inventor: Michel Dendooven, Kortrijk-Marke, Belgium

[73] Assignee: N.V. Bekaert S.A., Zwevegem, Belgium

[21] Appl. No.: 39,951

[22] Filed: Apr. 20, 1987

[51] Int. Cl.[4] ..... B23P 17/00

[52] U.S. Cl. ..... 29/419.1; 57/256; 139/425 R

[58] Field of Search ..... 29/419; 139/425 R; 264/119; 140/105

[56] References Cited

U.S. PATENT DOCUMENTS

| | | | |
|---|---|---|---|
| 2,368,689 | 2/1945 | Thomas | 139/425 R |
| 2,683,500 | 7/1954 | Goodloe | 140/105 X |
| 3,611,700 | 10/1971 | Vivien | 57/256 X |
| 3,805,853 | 4/1974 | Gladu | 140/105 |
| 3,828,543 | 8/1974 | Goodbar et al. | 139/425 R X |
| 3,838,983 | 10/1974 | Brown et al. | 29/419 R X |
| 3,905,831 | 9/1975 | Brown et al. | 139/425 R X |
| 3,953,913 | 5/1976 | Brown et al. | 139/425 R X |
| 4,010,004 | 3/1977 | Brown et al. | 139/425 R X |

FOREIGN PATENT DOCUMENTS

| | | | |
|---|---|---|---|
| 1957727 | 7/1973 | Fed. Rep. of Germany | 29/419.1 |

*Primary Examiner*—Timothy V. Eley
*Assistant Examiner*—Carl J. Arbes
*Attorney, Agent, or Firm*—Nixon & Vanderhye

[57] ABSTRACT

In a crimping process of metal fibers between the engaging pairs of gear rollers, the fibers are first embedded in a ductile and coherent matrix material. After applying a permanent crimping wave deformation on this composite, the matrix material is removed. The crimped fibers can subsequently be transformed to a metal fiber web. They can also easily be blended with textile fibers in order to form, e.g., antistatic blended yarn.

22 Claims, No Drawings

METHOD FOR THE MANUFACTURE OF GEAR-WHEEL CRIMPED METAL FIBERS AND PRODUCTS COMPRISING THESE FIBERS

BACKGROUND AND SUMMARY OF THE INVENTION

The invention concerns a method for the manufacture of gear roller crimped metal fibers and products comprising these fibers, e.g., in the form of metal fiber bundles. In addition, products derived therefrom such as blended yarns of textile and crimped metal fibers are described, as well as sintered and nonsintered metal fiber webs.

From the German utility model (Gebrauchsmuster) No. 7521192 of applicant, it is known to crimp metal fiber bundles by passing them between gear-wheels. However, in this process, the pressure on the bundle by the tooth tops during the crimping process causes the filament sections to plastically deform at the crimped tops, due to crushing. According to the relative position of the fibers in the bundle thickness however, this crimping operation will have a different crushing or flattening effect, and will consequently cause a certain arbitrariness to the continual and permanent character of the crimping along the bundle. Also, the bundle will often be strongly compacted in the area of the crimped tops, so that adjacent fibers could undesirably catch onto each other, which would render it difficult to separate them during later operations. This disadvantage could however be alleviated by opening the bundle laterally before it runs through the gear wheels. Besides the fact that this attempted solution requires an additional opening operation, it was found that such an opening operation will rarely give fully satisfactory results, i.e., realize a very durable crimping operation.

In order to avoid these disadvantages, this invention now proposes to avoid direct contact of the gear wheels with the fiber surface during the crimping operation. The method according to this invention for manufacturing a gear roller crimped metal fiber bundle with a permanent crimping wave deformation provides a practical solution to the above mentioned problems, by embedding the metal fiber bundle in a ductile and coherent matrix material, and subsequently passing this composite matrix/fiber bundle between the teeth of at least two intermeshing gear rollers, after which the matrix material is removed.

In accordance with the present invention, every fiber of the bundle should preferably be enveloped by the matrix material, so that each fiber will be separated from adjacent fibers. In this way, every single fiber in the bundle gets a permanent crimping deformation, without being touched by gear teeth or adjacent fibers. If the fibers in the composite are relatively straight and parallel to each other, this crimping deformation will be essentially identical in every fiber. Moreover, with this crimping deformation, the average fiber section form will remain the same for the whole length of the fiber. For certain purposes, it can be sufficient to apply a simple, almost sinusoidal zigzag crimping (in one plane) with a wave length W between 2 and 30 mm and a wave amplitude A between 0.2 and 7 mm with $W/A>2$ and preferably $W/A \geqq 4$. This crimping can be applied by passing the bundled composites, arranged in parallel, through the nip of two gear wheels that adequately engage or intermesh with each other, and that have mutual parallel axes of rotation.

Of course, the bundles can be forwarded successively through the nip of two or more pairs of gear rollers with mutual parallel axes of rotation. The depth of engagement with a next pair of rollers and/or the circumferential breadth of the individual tooth surfaces of the next pair of rollers could then differ from the previous pair. In this way, the crimping degree can be increased in steps, and/or one or more zigzag deformations can be superposed on the first one, in order to realize a more or less irregular crimping wave. By an adequate adjustment of the rollers, if desired, a crimping wave with a predetermined degree of irregularity can be realized. The limits for W and A, applied with the help of several pairs of gear rollers, will preferably lay between the values indicated above, so long as $W/A>2$. A dominating or base-crimping operation with zigzag form can be carried out with, e.g., 4 mm$<W<$20 mm or 4 mm$<W<$15 mm, and upon which then a second (and possibly a third) zigzag wave can be superposed with a smaller wave length.

Also, the composite matrix/fiber bundle can be passed through the nip of at least two cooperating pairs of gear rollers having axes of rotation that are nonparallel. This will also produce an irregular crimping wave, at least partly tri-dimensional as a result of the superposed zigzag deformations.

The metal fibers, e.g., stainles steel fibers, can have a diameter between 4 and 25 microns. The number of fibers in the composite bundle will preferably amount to no more than 2000, and will usually lie between 500 and 1500, in order to be able to realize an easy plastic crimping deformation, especially when the matrix material for the composite bundle is also a metal.

DETAILED DESCRIPTION OF THE INVENTION

An exemplary embodiment of the invention comprises the application of a gear roller crimping operation as has been described above on a metal fiber bundle obtained by a method of bundled drawing. Such methods have been described e.g., in the U.S. Pat. Nos. 2,050,298, 3,277,564 or 3,394,213. Metal wires are then covered with a coating consisting of a metal other than the wires (e.g. copper coatings on stainless steel wires). A bundle of these covered wires is subseguently enveloped in a metal pipe. After that, the loaded pipe is reduced via subsequent wire drawing steps to a composite bundle with a smaller diameter, whereby the wires are transformed into thinner fibers which are embedded separately in the continual ductile metal matrix of the covering material. Once the desired end diameter has been obtained, the covering material can be removed, according to the state of the art, by solution in an adequate pickling means or solvent, leaving the naked fiber bundle. According to a preferred embodiment of the invention however, the composite matrix/fiber bundle which has been reduced to the desired end diameter, is passed throuqh the nip of gear roller pairs before the pickling operation. Subsequently, the ductile metal matrix is removed, e.g., by a conventional pickling operation. The crimping treatment on the composite offers the further advantage that the pickling operation is more easily carried out.

With a discontinuous pickling operation, e.g., when the composite wire is coiled onto a holder, the number of free interspaces between the adjacent windings is extremely large, so that the pickling and rinsing liquids can easily penetrate between the wires. A continuous pickling line has an extended length from the first pickling bath to the winding station of the bundles which have been dried after rinsing. Moreover, composite wires are subjected to a number of changes in direction, which causes them to undergo a considerable drawing tension. Specifically, a number of crimped composite wires is bundled and drawn through the pickling installation as a bundle. The crimping allows the bundle to distribute and elastically absorb drawing tensions which are spread over the wires. In this way, on the one hand wire ruptures are avoided, and on the other hand, the composite wires can mutually shift slightly with respect to each other in the longitudinal direction. This increases the liquid turbulence in the pickling and rinsing baths near the bundle. A number of simultaneously crimped bundles are assembled and wound up together after pickling, rinsing and drying to a voluminous continuous filament bundle with any number of filaments, usually in the thousands.

If desired, this multifilament bundle can be transformed or processed by means of an ordinary textile breaker (e.g., drafting frames) into a voluminous staple fiber sliver, via one or more drawing operations. Since the crimping wave in the assembled subbundles is usually not identical, and has shifted over the length, i.e., dephased, from the one bundle to the other, a more voluminous bundle and a more arbitrary distribution of the rupture places over the length of the bundle is obtained with breaking. When an irregular crimping wave has been applied to the composite wires, then, of course, an even more pronounced voluminosity in the bundle can be expected. By breaking the bundles on the drafting frames, the crimping waves are more or less forced to orient themselves in the plane of the nip between both the supplying rollers and the breaking or outlet rollers of the drafting frames. In this way, automatic lateral opening of the bundle is promoted. This opening has proven favorable in view of a possible further mixing or blending operation with textile fibers to a blended sliver. Subsequently to, or simultaneously with the breaking operation to form a fiber sliver, the crimped metal fiber bundles are actually put together and mixed with other fibers, like textile fibers on the ordinary drafting frames (with or without gill-box). A transformation to mixed yarns with a chosen metal fiber content and a chosen average metal fiber length can be carried out in the usual way, by doubling the textile slivers, by forming rovings and eventually by spinning.

The application of the crimped metal fibers guarantees an easier homogeneous or uniform mixing, which also brings about more constant characteristics and quality of the yarns. As known, the obtained blended yarns can, of course, be incorporated in woven fabrics, in net works, in pile fabrics, e.g., for antistatic purposes or for reflection/absorption of microwaves. The voluminosity of the crimped bundles can also be increased by combining bundles with different crimping wave deformation such as: a zigzag crimping with different W and/or A values, or plane zigzag crimped bundles with tri-dimensional crimped bundles, or a mutual combination of these or with noncrimped bundles, so that at least one bundle possesses a crimping form differing from the others. Also, the voluminosity can be influenced by making an appropriate choice of possible combinations of bundle thicknesses and numbers.

The voluminous filament bundles or staple fiber slivers according to the invention, can also easily be processed into a nonwoven metal fiber web by e.g., a card operation which may or may not be combined with a pneumatic fiber transport. Subsequently, to a drafting process of the filament bundles to staple fibers, said fibers can easily be separated and almost completely be individualized in an air stream, and be supplied to a web forming device, such as a card or a Rando-Webber ® (trade name of Curlator Corp. USA). The highly voluminous metal fiber webs so obtained are very uniform in porosity. After the adequate densification rolling or pressing (e.g., hydraulic isostatic compaction) and a usual sintering operation to plates with a desired uniform porosity, they are thus very useful for, e.g., filtration media for high temperature applications. Also, the highly voluminous webs can be densified by needling or fluid jet needling (spunlaced fabrics) and either followed or not by a sintering operation. A fluid jet needling process is described, e.g., in the U.S. Pat. No. 3,493,462.

EXAMPLE

A number of composite wires with a diameter of 0.25 mm are successively pulled through the nip of two pairs of gear rollers . In the first nip, a zigzag deformation is imposed with a wave length W of 7.5 mm and an amplitude A of 1.15 mm. On this, in a second nip, a zigzag deformation is superposed with W=6 mm and A=0.8 mm. The gear tooth tops are slightly rounded. The so deformed composite wire shows a slightly irregular crimping wave, in which nowhere between the successive crimping tops do wire segments occur that form an angle bigger than 60° with the neutral axis (main direction) of the crimped composite wire. Of course, the applied crimping deformation slightly straightens out upon winding up of the crimped wire. This occurs to such an extent that (at least) the elastic part of the applied bends again disappears.

To characterize the crimping degree, a piece of this crimped wire is drawn through a first tubular metal caliber provided with a cylindrical channel with a smooth inner wall, with a length of 20 mm and a predetermined channel diameter $K_1$ of 0.90 mm. The wire can easily be pulled through (without any noticeable drawing resistance). Subsequently, it is attempted to draw the crimped wire through a second, similar caliber with a predetermined channel diameter $K_2=0.65$ mm. This fails however, unless a relatively high drawing power is applied upon pulling through, thereby causing the imposed crimp to be straightened out (to a certain extent).

A composite wire with a certain diameter D will have an appropriate crimp when it can be pulled without any noticeable resistance through a first but not through a second caliber. In addition, a predetermined relation is advisable between wire diameters D and the appertaining channel diameters $K_1$ and $K_2$ to obtain an appropriate crimp (e.g., with more or less regularity in the crimping wave) in accordance with the later intended application of the crimped fiber for, e.g., antistatic textile, or as conductive filling for synthetic resin material. For the crimped wire according to this example, $$K_2 = \frac{0.65}{0.25} = 2.6 \text{ and } K_1/D = \frac{0.90}{0.25} = 3.6$$

It is estimated that the following can be applied as an appropriate relation:

$$2D < K_2 < 3D \text{ and } 3D < K_1 < 4D.$$

The diameter D of the composite wire depends, of course, on the number of fibers in the composite bundle and on the fiber diameters. D will lie between 0.1 mm and 1.5 mm for fiber diameters between 4 and 25 $\mu$m.

A number of the crimped composite wires is then bundled and this bundle is treated in a well known way with an acid pickling solution ($HNO_3$), in order to remove the matrix material out of the composite wires, so that a crimped fiber bundle remains which consists of as many subbundles as composite wires were present.

While the invention has been described in what is presently regarded as the most practical embodiments thereof, one of ordinary skill in the art will understand that many alterations may be made therein without departing from the spirit and scope of the claims which follow.

I claim:

1. A method of manufacturing a gear crimped metal fiber bundle, comprising the steps of: (a) embedding the metal fibers in a ductile and coherent matrix material to form a composite matrix/fiber bundle; (b) passing this composite matrix/fiber bundle between teeth of at least two intermeshing gear rollers provided with parallel axes of rotation, so that the fibers receive a permanent crimping wave deformation; and (c) removing the matrix material.

2. A method according to claim 1, wherein during the practice of step (a), every fiber is covered by matrix material and so separated from the adjacent fibers in the bundle.

3. A method according to claim 1, wherein said gear rollers are provided with parallel axes of rotation in order to form an almost sinusoidal zigzag crimp in said composite with a wave length W between 2 and 30 mm and a wave amplitude A between 0.2 and 7 mm where $W/A>2$.

4. A method according to claim 3 wherein $W/A \geqq 4$.

5. A method according to claim 1, wherein step (b) is practiced by passing the composite through the nip of at least two cooperating pairs of gear rollers, in order to form an irregular crimping wave deformation as a result of superposing one zigzag configuration on another.

6. A method according to claim 1, wherein the bundle contains a maximum of 2000 fibers with a diameter between 4 and 25 microns.

7. A method according to claim 2, wherein the matrix material is a metal differing from the metal of the fiber.

8. A method according to claim 1, and including the further step of processing one or more crimped fiber bundles to a crimped staple fiber sliver by at least one drawing operation.

9. A method according to claim 8, wherein at least one of the crimped fiber bundles possesses a crimping configuration different from the other bundles.

10. A method according to claim 8, wherein said one or more fiber bundles are combined with other fiber bundles during the drawing operation.

11. A method according to claim 10, wherein the metal fibers are blended with textile fibers.

12. A method according to claim 11, wherein the blended metal and textile fibers are spun into a blended yarn.

13. A method according to claim 8, wherein the fibers of the crimped staple fiber slivers are separated and, almost completely individualized and supplied to a fiber web forming device where they are processed into web through a carding operation combined with a pneumatic fiber transport.

14. A method according to claim 13, wherein said web is sintered.

15. A method according to claim 13, wherein said obtained web is densified by fluid jet needling.

16. A metal multi-fibered bundle produced by the method of claim 2.

17. A blended yarn constructed in accordance with the method of claim 12.

18. A metal fiber web constructed in accordance with the method of claim 13.

19. A method of manufacturing a gear crimped metal fiber bundle, comprising the steps of: (a) embedding the metal fibers in a ductile and coherent matrix material; (b) passing this composite matrix/fiber bundle between teeth of at least two intermeshing gear rollers, so that the fibers receive a permanent crimping wave deformation; (c) removing the matrix material; and (d) processing one or more crimpled fiber bundles to a crimped staple fiber sliver by at least one drawing operation, wherein at least one of the crimped fiber bundles possesses a crimping configuration different from the other bundles.

20. A method according to claim 19, wherein said one or more fiber bundles are combined with other fiber bundles during the drawing operation.

21. A method according to claim 20, wherein the metal fibers are blended with textile fibers.

22. A method according to claim 21, wherein the blended metal and textile fibers are spun into a blended yarn.

* * * * *

UNITED STATES PATENT AND TRADEMARK OFFICE

CERTIFICATE OF CORRECTION

PATENT NO. : 4,779,322

DATED : October 25, 1988

INVENTOR(S) : Dendooven

It is certified that error appears in the above-identified patent and that said Letters Patent is hereby corrected as shown below:

Column 2, line 45 delete "subseguently" and insert --subsequently--;

Column 2, line 58, delete "throuqh" and insert --through--.

Column 4, line 2, delete "Subsequently," and insert --Subsequent--;

Column 4, line 62, delete "$K_2$" and insert --$K_2/D$--.

Column 6, line 37, delete "crimpled" and insert --crimped--.

Signed and Sealed this

Twenty-eighth Day of March, 1989

*Attest:*

DONALD J. QUIGG

*Attesting Officer*

*Commissioner of Patents and Trademarks*